United States Patent [19]

Shah

[11] 3,941,470

[45] Mar. 2, 1976

[54] TONER PARTICLE DISPENSER

[75] Inventor: Naginchand A. Shah, Penfield, N.Y.

[73] Assignee: Xerox Corporation, Stamford, Conn.

[22] Filed: June 17, 1974

[21] Appl. No.: 479,706

[52] U.S. Cl. ..... 355/3 DD; 118/637; 222/DIG. 1

[51] Int. Cl.[2] ..... G03G 15/08

[58] Field of Search ..... 355/3 R, 3 DD; 118/637; 117/17.5; 222/DIG. 1

[56] References Cited

UNITED STATES PATENTS

| | | | |
|---|---|---|---|
| 2,910,964 | 11/1959 | Stavrakis et al. | 118/637 |
| 3,692,403 | 9/1972 | Turner | 355/3 DD |

FOREIGN PATENTS OR APPLICATIONS

| | | | |
|---|---|---|---|
| 45-14514 | 5/1970 | Japan | 355/3 DD |
| 46-2720 | 1/1971 | Japan | 355/3 DD |

*Primary Examiner*—Robert P. Greiner

*Attorney, Agent, or Firm*—H. Fleischer; J. J. Ralabate; C. A. Green

[57] ABSTRACT

An apparatus in which a quantity of particles is stored and gradually dispensed to a mix thereof. Bridging and caking of the particles is prevented by forming grooves and inducing vibrations in the developer mix at predetermined intervals of time.

6 Claims, 3 Drawing Figures

TONER PARTICLE DISPENSER

BACKGROUND OF THE INVENTION

This invention relates generally to an electrostatographic printing machine, and more particularly concerns an improved toner dispensing apparatus for use therein.

The art of electrostatographic printing includes both electrographic printing and electrophotographic printing. In these processes, an electrostatic latent image, which corresponds to the original document being reproduced, is recorded. Electrophotography achieves this by charging a photosensitive element having a photoconductive insulating layer to a substantially uniform potential. The charged photoconductive surface is exposed to a light image of the original document. As a consequence of this exposure, the charge is selectively dissipated in the irradiated areas in accordance with the light intensity reaching the photoconductive surface. This creates the electrostatic latent image thereon. Electrographic printing differs from electrophotographic printing only in that the electrostatic latent image is created without the use of photosensitive materials. Hence, the process of electrophotographic printing requires the use of a suitable photoconductor whereas electrography does not.

Development of the electrostatic latent image, in electrophotography and electrography, is accomplished by contacting the latent image with a developer mix. Generally, a suitable developer mix comprises dyed or colored thermoplastic particles, known in the art as toner particles, mixed with carrier granules, such as ferromagnetic granules. The toner particles and carrier granules are triboelectrically attracted to one another with the toner particles adhering to the outer surface of the carrier granules. As the developer mix contacts the latent image, the greater attractive force of the latent image causes the toner particles to transfer thereto from the carrier granules. The toner particles adhere to the latent image in image configuration.

It is apparent that during the development cycle, toner particles are depleted from the developer mix. Thus, additional toner particles must be furnished to the developer mix so as to maintain copy density at a substantially optimum level. It is evident that in order to produce an efficient printing machine, it is necessary to conveniently and effectively replenish the toner particles used in the formation of copies.

Hereinbefore, various techniques were employed to dispense toner particles into the developer mix. For example, U.S. Pat. No. 2,892,446 issued to Olden in 1959; U.S. Pat. No. 2,910,964, issued to Stavrakis et al., in 1959; and U.S. Pat. No. 3,134,849, issued to Frohbach et al. in 1964, all disclose various techniques for dispensing toner particles from a hopper while the hopper is being vibrated. Another technique is taught in U.S. Pat. No. 3,003,703 issued to Hunt in 1969. Hunt teaches the use of a reciprocating gate on the bottom of a toner dispenser to discharge particles therefrom. Finally, U.S. Pat. No. 3,389,863 issued to Eichorn in 1968 discloses a toner container adapted to dispense toner particles from a block of toner. A plurality of reciprocating blades are mounted in the bottom of the container. The block of toner is biased against the blades. The blades are bent in a honeycombed configuration to insure complete coverage of the toner block and are mounted in a pair of end blocks. As the blades move across the surface of the toner block, they produce a scraping action which removes portions of the toner material therefrom.

None of the foregoing patents describe an apparatus adapted to prevent the bridging and caking of toner particles in a toner dispenser employed in a low-volume printing machine. In low copy volume printing, the toner particles frequently bridge and cake over the openings in the container preventing toner particle dispensing. This frequently results in light copies and customer dissatisfaction. In the past, this condition has been corrected by periodically manually stirring the toner particles.

It is the primary object of the present invention to improve toner particle dispensing by preventing bridging and caking of the particles.

SUMMARY OF THE INVENTION

Briefly stated and in accordance with the present invention, there is provided an apparatus for dispensing particles.

Pursuant to the preferred features of the present invention, the apparatus includes means for storing a supply of particles. Means are provided for vibrating the storing means at predetermined intervals of time. A dispensing member is mounted slidably on the storing means. The dispensing member has a plurality of apertures therein arranged to permit the passage of particles therethrough as it reciprocates. At least one blade member is operatively associated with the dispensing member. The blade extends into the supply of particles and is arranged to form grooves therein as the dispensing member reciprocates.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment, it will be understood that it is not intended to limit the invention to that embodiment. On the contrary, it is intended to cover all alternatives, modifications, and equivalents that may be included within the spirit and scope of the invention as defined by the appended claims.

DETAILED DESCRIPTION OF THE INVENTION

Figure 1:
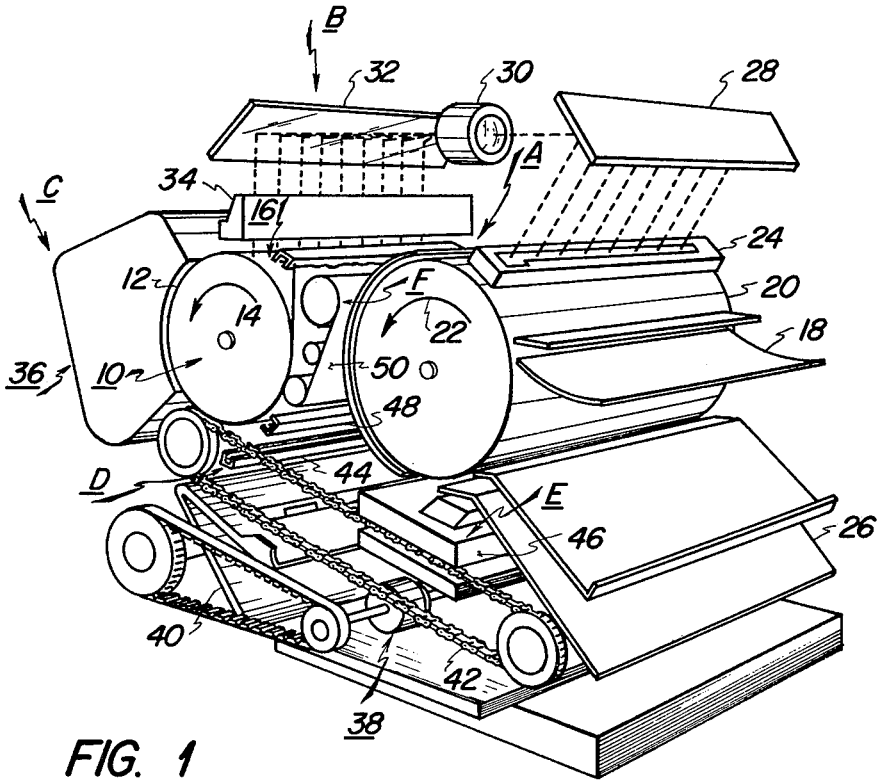
FIG. 1 is a schematic perspective view of an electrophotographic printing machine embodying the features of the present invention therein.

A general understanding of an electrophotographic printing machine, in which the present invention may be incorporated, is had by referring to FIG. 1. FIG. 1 schematically illustrates the various components of an electrophotographic printing machine adapted to employ the features of the present invention therein. Continued reference will hereinafter be made to the drawings wherein like reference numerals have been used throughout to designate like elements. Although the apparatus of the present invention is particularly well adapted for use in an electrophotographic printing machine, it should become evident from the following discussion that it is equally well suited for use in a wide variety of dispensing devices and is not necessarily limited in its application to the particular embodiment shown herein.

With continued reference to FIG. 1, the printing machine employs a drum 10 having a photoconductive surface 12 entrained about and secured to the circumferential surface thereof. A synchronous speed motor (not shown) rotates drum 10 in the direction of arrow 14. As drum 10 rotates, photoconductive surface 12 passes sequentially through a series of processing stations. These processing stations will hereinafter be described briefly.

Initially, drum 10 rotates in the direction of arrow 14 to move photoconductive surface 12 through charging station A. A corona generating device, indicated generally at 16, is positioned at charging station A. Corona generating device 16 extends in a generally longitudinal direction transversely across photoconductive surface 12. In operation, corona generating device 16 charges photoconductive surface 12 to a relatively high, substantially uniform potential. A suitable corona generating device is described in U.S. Pat. No. 2,836,725 issued to Vyverberg in 1958.

After photoconductive surface 12 is uniformly charged, drum 10 rotates to exposure station B. At exposure station B, an original document passes through chute 18 and is grasped by grippers (not shown) mounted on document drum 20. The grippers hold the original document against drum 20. Drum 20 rotates in the direction of arrow 22 and pulls the original document into the machine under exposure lamps 24. Exposure lamps 24 are located above document drum 20 and illuminate incremental areas of the document as drum 20 rotates. After exposure, the grippers release the original document which passes through chute 26 into a catch tray (not shown). The catch tray is situated so as to enable a machine operator to readily remove the original document from the printing machine. The light image of the original document is reflected by object mirror 28 through stationary lens 30 to the image mirror 32. Image mirror 32 reflects the light image through exposure slit 34 onto charged photoconductive surface 12. As the light image irradiates areas of photoconductive surface 12, selected portions thereof are discharged to record thereon an electrostatic latent image corresponding to the original document.

After recording the electrostatic latent image on photoconductive surface 12, drum 10 rotates to development station C. At development station C, the electrostatic latent image recorded on photoconductive surface 12 is rendered visible by depositing toner particles thereon. In the development system, a developer mix of carrier granules, i.e. ferromagnetic granules, and toner particles, i.e. heat settable thermoplastic particles, are brought into contact with the electrostatic latent image to form a powder image on photoconductive surface 12. The apparatus adapted to develop the electrostatic latent image is generally referred to hereinafter by the reference numeral 36. Numerous types of development systems are suitable for rendering the electrostatic latent image visible. However, in the electrophotographic printing machine depicted in FIG. 1, a cascade development system is employed. Cascade development system 36 will be described hereinafter in greater detail with reference to FIG. 2.

At the proper time during the machine cycle, a pair of feed rollers, indicated generally by the reference numeral 38, move from the inoperative position spaced from the uppermost sheet of the stack of support material to the operative position in contact therewith. The feed rollers advance the uppermost sheet into chute 40. A pair of gripper bars mounted on chain 42 advance past chute 40 and grasp the support material therebetween. The gripper bars draw the support material from chute 40 and move it between drum 10 and corona generating device 44. Corona generating device 44 applies an electrostatic charge to the support material to attract thereto the toner powder image adhering to photoconductive surface 12. A gripper bar continually moves the sheet of support material through transfer station D. After the entire toner powder image has been transferred to the sheet of support material, the gripper bars advance the support material with the toner powder image adhering thereto, to fixing station E. The sheet feeding apparatus depicted in FIG. 1 is described in greater detail in co-pending application Ser. No. 460,627 filed in 1974, the disclosure of which is hereby incorporated into the present application.

Fixing station E includes a fuser 46 having suitable radiant heating elements and control circuits for maintaining the temperature thereof substantially constant to permanently affix the toner powder image to the sheet of support material advancing therethrough. After exiting fuser 46, the support material passes from the electrophotographic printing machine to the catch tray. The sheet of support material then enters the catch tray where it may be readily removed therefrom by the machine operator.

Continuing now with the printing process, drum 10 next passes through cleaning station F. At cleaning station F, pre-clean corona generating device 48 applies a charge potential to photoconductive surface 12. This neutralizes the remaining charge on photoconductive surface 12 as well as the charge remaining on the residual toner particles adhering thereto. Web cleaning system 50, then removes the residual toner particles from photoconductive surface 12. Photoconductive surface 12 is now ready for the next machine cycle. The foregoing machine cycle is repeated for each successive copy being reproduced.

It is believed that the foregoing description is sufficient for purposes of the present application to illustrate the general operation of an electrophotographic printing machine embodying the teachings of the present invention therein.

Figure 2:
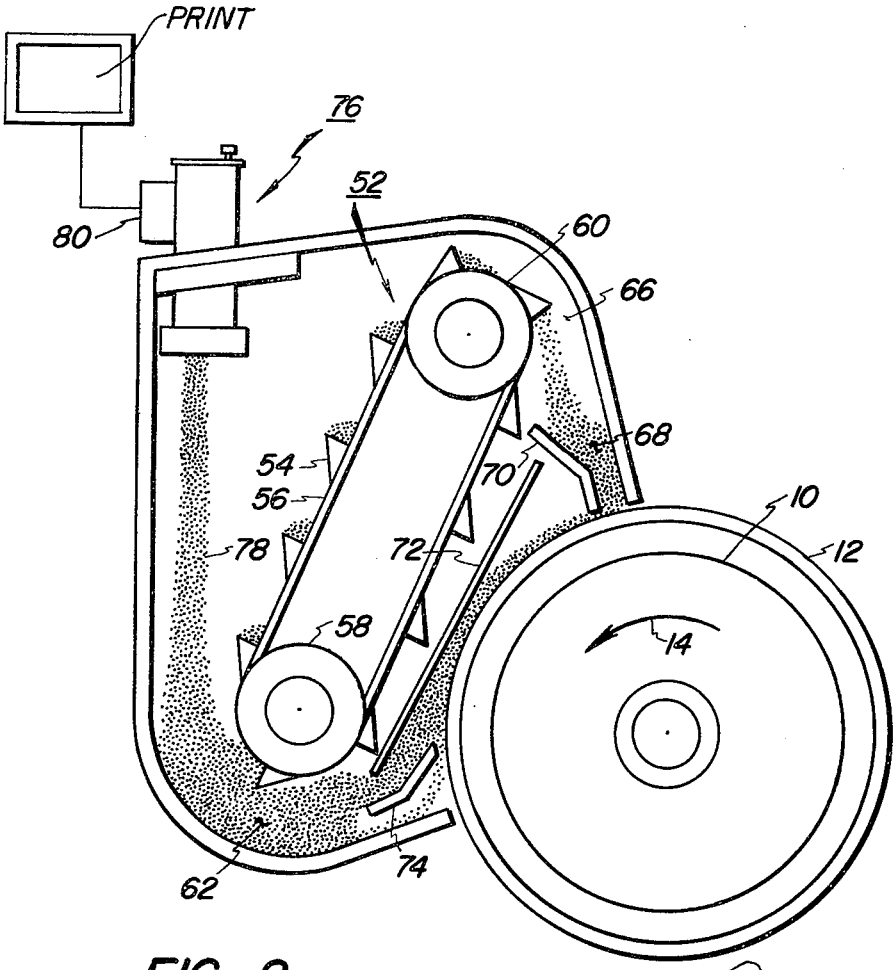
FIG. 2 is a schematic elevational view of the development system employed in the FIG. 1 printing machine.

Referring now to FIG. 2, development system 36 is depicted therein in detail. As hereinbefore indicated, development system 36 is a cascade system. In cascade development, developer mix 66 is transported from a sump or lower region 62 to an upper region 66 where it is discharged to cascade in a downwardly direction over photoconductive surface 12 forming a toner powder image on the electrostatic latent image recorded thereon. The cascade system includes a conveyor system, designated generally by the reference numeral 52, arranged to advance developer mix 64 from sump 62 to the discharge region 66. Conveyor system 52 employs buckets 54 secured to an endless belt 56 entrained about a pair of spaced rollers 58 and 60, respectively. Buckets 54 pass through sump 62 and are filled with developer mix 64 which is transported in an upwardly direction therefrom to upper region 66 of the development system. At upper region 66, buckets 54 discharge developer mix 64 enabling it to pass between flow baffles 68 and 70, respectively, onto photoconductive surface 12. Guide plate 72 maintains developer mix 64 closely proximate to photoconductive surface 12. The denuded carrier particles and the residual developer mix are then returned to sump 62 by pick off baffle 74. Toner particle dispenser 76 contains a fresh supply of toner particles 78 which passes therefrom into the stream of developer mix 64. Adding toner particles 78 at this location insures a flow in a downwardly direction into sump 62 so as to be mixed with the denuded carrier granules. Additional toner particles 78 are added to developer mix 64 in order to replace those used in forming the powder images. This maintains the concentration thereof substantially constant, providing uniform copy quality. Dispenser 76 includes a vibrator 80 adapted to vibrate the housing of toner dispenser 76 at periodic time intervals so as to assist in providing a uniform toner particle flow therefrom. Vibrator 80 is excited each time the print button is depressed for making new copies in the electrophotographic printing machine. This periodic vibration of the toner dispensing housing aids in the prevention of bridging and caking of the toner particles within the toner dispenser. The detailed structural configuration of toner dispenser 76 will be described hereinafter, in greater detail, with reference to FIG. 3.

Figure 3:
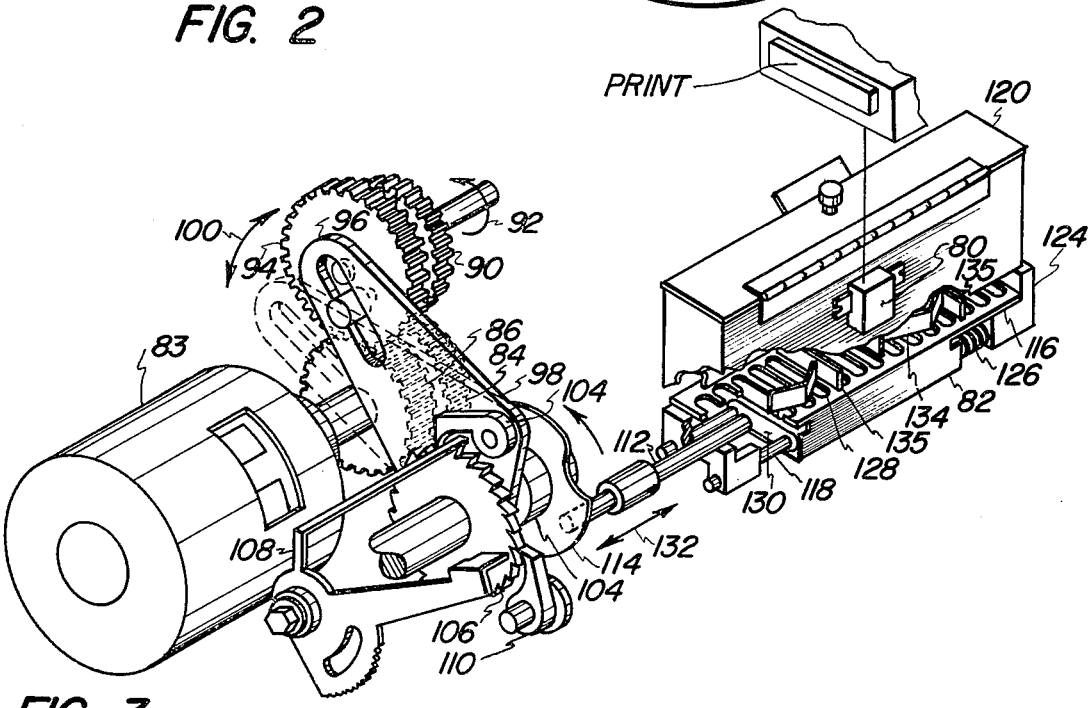
FIG. 3 is a schematic perspective view of a particle dispensing apparatus used in the FIG. 2 development system.

Turning now to FIG. 3, toner dispenser 78 is shown therein in greater detail. As hereinbefore indicated, development of the latent image on photoconductive surface 12 removes toner particles from the developer mix. The developer mix is replenished with new toner particles from toner dispenser 78. Toner dispenser 76, which is an integral part of the development system, holds about one-half lbs. of toner. Toner is dispensed into sump 62 (FIG. 2) when sifter 82 moves back and forth across the bottom of toner dispenser 78. Developer drive motor 83, when energized, turns gears 84 and 86 mounted on motor shafts 88. Gear 84 drives gear 90 which drives the developer conveyor drive shaft rotating endless conveyor belt 56 (FIG. 2) of the development system. Gear 90 rotates in the direction of arrow 92. Gear 86 also drives toner dispenser gear 94 in the direction of arrow 92. Gear 94 has an eccentric pin 96 secured thereto. However, gear 94 is not secured to the developer drive shaft, and is free to rotate at a different speed than gear 90. As gear 94 rotates, eccentric pin 96 pivots link 98 in the direction of arrow 100. Link 98, which pivots about wobble plate shaft 102, has pawl 104 secured thereto. On the upward motion of link 98, pawl 104 raises up and away from ratchet 106. This is caused by pawl 104 engaging an extension of toner lever 108. On the downward motion of link 98, pawl 104 engages (ratchet 106). Ratchet 106 is secured to wobble plate shaft 102. As pawl 104 engages ratchet 106, shaft 102 is turned part of a revolution. A spring loaded stationary pawl 110 prevents ratchet 106 from being driven in the reverse direction by spring loaded plunger 112 pressing against the irregular surface of wobble plate 114. The downward motion of pawl 104 is controlled by toner level 108. The position of toner lever 108 determines the amount of time that pawl engages ratchet 106 for each revolution of the toner dispenser gear 94. Hence, each time toner dispenser gear 94 makes one revolution, ratchet 106 makes only a part of a revolution. Wobble plate 114 is secured to shaft 102 in addition to ratchet 106. As pawl 104 turns ratchet 106, it also rotates wobble plate 114. The irregular surface of wobble plate 114 reciprocates plunger 112. Reciprocating plunger 112 forces sifter 82 to move laterally against springs 116 mounted on toner dispenser rods 118. As the high lobe on wobble plate 114 passes plunger 112, springs 116 force sifter 82 to return to its initial position.

With continued reference to FIG. 3, hopper or housing 120 holds toner particles 78 to be dispensed therefrom. Although hopper 120 may be made from any suitable material in any size or shape, preferably, it is fabricated from sheet metal into a rectangular open-ended box having vertical side walls and end walls. The upper ends of the walls are bent outward to form horizontal flanges for attaching the hopper to the development housing. At opposite ends of hopper 120 are positioned bearing blocks or support members 122 and 124. Support members 122 and 124 have rods 118 secured thereto. The bottom of hopper 120 is partially closed by sifter 82. Sifter 82 includes a dispensing plate or platform 126 positioned in a spaced vertical relation below the lower edges of the walls of hopper 120. Dispensing plate 126, which is as wide as hopper 120, is secured to support members 122 and 124. Dispensing plate 126 combines with the walls of hopper 120 to provide a reservoir having narrow elongated discharge outlets or discharge passages 128 permitting the flow of toner particles therethrough.

A substantially uniform flow of toner particles is effected through passages 128 by a dispensing grid 130 mounted for reciprocating movement on rods 118. Grid 130 has a plurality of transverse perforations of slots formed therein. Plunger rod 112 is secured thereto. As plunger rod 112 reciprocates in the direction of arrow 132 grid plate 130 moves in conjunction therewith sifting and dispensing the toner particles from hopper 120. A plurality of blade members 134 (in this case three) are secured to grid 130 and move in conjunction therewith forming grooves in the toner particles stored in hopper 120. This prevents the bridging and caking of the toner particles and facilitates the dispensing thereof from hopper 120. A plurality of stop members 135 (in this case two) are secured stationarily to dispensing plate 126. Stop members 135 prevent the movement of the toner particles with blade member 134 so as to insure that grooves are formed therein. Preferably, stop members 135 in an upwardly direction into the supply of toner particles. Stop members 135 have a generally planar surface substantially normal to the direction of movement of plunger rod 112 as indicated by arrow 132. At periodic time intervals vibrator 80 is excited so as to vibrate hopper 120 and the toner particles contained therein. This vibration causes the toner particles to fill the grooves formed by blades 134. Blades 134 extend in an upwardly direction into the supply of toner particles and are preferably S shaped. Vibrator 80 is excited each time the print button of the electrophotographic printing machine depicted in FIG. 1 is excited. Thus, hopper 120 is vibrated once per original document.

By way of example, vibrator 80 vibrates at 3600 cycles per minute from a voltage source of 110 volts. One type of suitable vibrator is manufactured by Sensonics of Long Island, New York, and is Model No. 606.

In recapitulation, bridging and caking of toner particles, which prevents the uniform dispensement thereof from a hopper, is prevented by the apparatus of the present invention. This apparatus includes a plurality of blade and associated stop member extending into the supply of toner particles so as to form grooves therein. These grooves are filled with loose toner particles when the hopper housing the toner particles is periodically vibrated. Thus, the apparatus of the present invention facilitates the uniform dispensing of toner particles from a hopper by preventing toner bridging and caking. This eliminates the heretofore required manual operation of stirring the particles at periodic time intervals.

It is, therefore, evident that there has been provided in accordance with the present invention, an apparatus for dispensing toner particles that fully satisfies the objects, aims and advantages set forth above. While this invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An electrostatographic printing machine of the type having an electrostatic latent image of an original document being reproduced recorded on an insulating medium, wherein the improvement includes:

a housing member defining a chamber for storing a developer mix comprising carrier granules and toner particles;

means for vibrating said housing member at predetermined intervals of time;

a dispensing member mounted on said housing member and having a plurality of apertures therein arranged to permit toner particles to pass therethrough;

at least one blade member operatively associated with said dispensing member, said blade member having a generally planar surface extending into the supply of toner particles in said housing member;

means for reciprocating said blade member in a direction transverse to the planar surface thereof so that said blade member forms a groove in the particles preventing the bridging and caking thereof; and at least one stop member operatively associated with said dispensing member and having a generally planar surface extending into the supply of toner particles in a direction substantially normal to the direction of reciprocation of said blade member, said stop member remaining substantially stationary as said blade member reciprocates to prevent the movement of the toner particles therewith.

2. A printing machine as recited in claim 1, further including means for depositing toner particles onto the electrostatic latent image forming a powder image corresponding to the original document being reproduced.

3. A printing machine as recited in claim 2, wherein said dispensing member is mounted slidably on said housing member for reciprocating movement and further includes means for reciprocating said dispensing member.

4. A printing machine as recited in claim 3, wherein said housing member includes a hopper having end walls and side walls for retaining toner particles, said hopper having an open bottom with said dispensing member positioned thereat.

5. A printing machine as recited in claim 3, wherein said reciprocating means includes:

drive means;

a plunger rod mounted movably in said storing means and connected to said dispensing member; and means for connecting said drive means with said plunger rod so that drive means moves said plunger rod imparting reciprocating movement to said dispensing member.

6. A printing machine as recited in claim 5, wherein said dispensing member includes:

support means secured to opposite walls of said hopper;

a plurality of rod members connected in spaced parallel relation to each other on said support means;

a dispensing platform secured to said support means in spaced parallel relation to said hopper; and a substantially rigid dispensing grid mounted slidably on said rod members for reciprocating movement between opposed walls of said hopper.

* * * * *